US011730996B2

(12) United States Patent
Caputi

(10) Patent No.: US 11,730,996 B2
(45) Date of Patent: Aug. 22, 2023

(54) RUNNING BENDED EXERCISER

(71) Applicant: Giancarlo Caputi, Naples (IT)

(72) Inventor: Giancarlo Caputi, Naples (IT)

( * ) Notice: Subject to any disclaimer, the term of this patent is extended or adjusted under 35 U.S.C. 154(b) by 51 days.

(21) Appl. No.: 17/618,456

(22) PCT Filed: Sep. 9, 2020

(86) PCT No.: PCT/IT2020/050217

§ 371 (c)(1),
(2) Date: Dec. 11, 2021

(87) PCT Pub. No.: WO2021/048885

PCT Pub. Date: Mar. 18, 2021

(65) Prior Publication Data

US 2022/0323811 A1 Oct. 13, 2022

(30) Foreign Application Priority Data

Sep. 11, 2019 (IT) ..... 102019000016064

(51) Int. Cl.
*A63B 21/00* (2006.01)

(52) U.S. Cl.
CPC .... *A63B 21/00047* (2013.01); *A63B 21/4035* (2015.10); *A63B 2208/0204* (2013.01); *A63B 2210/50* (2013.01); *A63B 2225/093* (2013.01)

(58) Field of Classification Search
None
See application file for complete search history.

(56) References Cited

U.S. PATENT DOCUMENTS 3,516,425 A * 6/1970 Rigal ..... A61H 3/00 248/157
4,094,331 A * 6/1978 Rozsa ..... A61H 3/00 135/67
4,135,535 A * 1/1979 Thomas ..... A61H 3/00 482/66
5,277,438 A * 1/1994 Chuang ..... A61H 3/04 280/42
6,666,222 B1 * 12/2003 Fattahi ..... A61H 3/04 135/67
9,649,523 B2 * 5/2017 Brady ..... A63B 21/068
2013/0324383 A1 12/2013 Rogers
2015/0065316 A1 3/2015 Towley, III et al.
2016/0287968 A1 * 10/2016 Brady ..... A63B 21/068
2018/0361201 A1 12/2018 Dungee

* cited by examiner

*Primary Examiner* — Joshua Lee
(74) *Attorney, Agent, or Firm* — Preston Smirman; Smirman IP Law, PLLC

(57) ABSTRACT

An exerciser allows two new exercises to be performed. The new exercises enabled by the exerciser include a leaning miming in place exercise and 2) a traction in suspension exercise. Two identical rectangle-shaped supports, hinged on two adjacent vertical sides permit a user to grip upper horizontal handle-bars. When not in use, the exerciser can be folded, occupying a very small space.

12 Claims, 2 Drawing Sheets

RUNNING BENDED EXERCISER

TECHNICAL FIELD

The invention relates to training equipments.

BACKGROUND ART

Running in place exercisers are generally meant to permit a user to run at home while a machine activates a tapis-roulant. Therefore the user runs in straight position, which increases compression of his back. Moreover, these machines are heavy and bulky and expensive. Actually there are no tools for running leaning and bended, which is an exercise of my invention (FIG. 4). With regards to traction in suspension exercise (FIG. 5), it can be practiced with the parallel bars for artistic gymnastics, a very heavy and bulky exerciser.

DISCLOSURE OF INVENTION

The invention relates to an exerciser (1) comprising two identical rectangle-shaped support elements, or supports (2,2'), hinged on two adjacent vertical sides (18,18'). Each support has an upper horizontal member (22,22') usable as a handle-bar (22,22'), a lower horizontal member (12,12') meant as support base, a first lateral member, a second lateral member. Each of said lateral members comprises two sliding elements for height adjusting.

With reference to support (2) first lateral member comprises element (16) and element (24) housed in said element (16). Second lateral member comprises element (18) and element (26), housed in said element 18, as better disclosed below.

One of said vertical elements (18) has hinges (20) for connection with corresponding element (18') of second support (2').

Therefore said supports (2,2') can be rotated in an open position (when used) generating an angle-space in which a user can place himself (FIG. 1, three-dimensional view; FIG. 2, view from above), or in a folded close position (when not used) (FIG. 3, view from above). Each of said supports (2,2') can adjust the height of upper horizontal member (22,22'), usable as a handle-bar (22,22'), to which a user can grab, keeping his back in a substantially horizontal position (FIG. 4). In said position the weight of the user is largely supported by his arms. Therefore, when he acts the running movements his vertebrae are not compressed, just as it happens while swimming. Arms are reinforced and circulation in legs is increased, knees are not stressed, as they carry less weight (running leaning bended in place exercise).

The exerciser can be used in a further way (FIG. 5), if the user puts himself backwards to the hinges and bows his arms while relaxing his legs, he obtains a vertebral traction and arms training (Traction in suspension exercise).

When not in use, the exerciser can be folded occupying a small space (FIG. 3). When used, said supports are open at the desired angle, comfortable for grabbing.

BEST MODE FOR CARRYING OUT THE INVENTION

Figure 1:
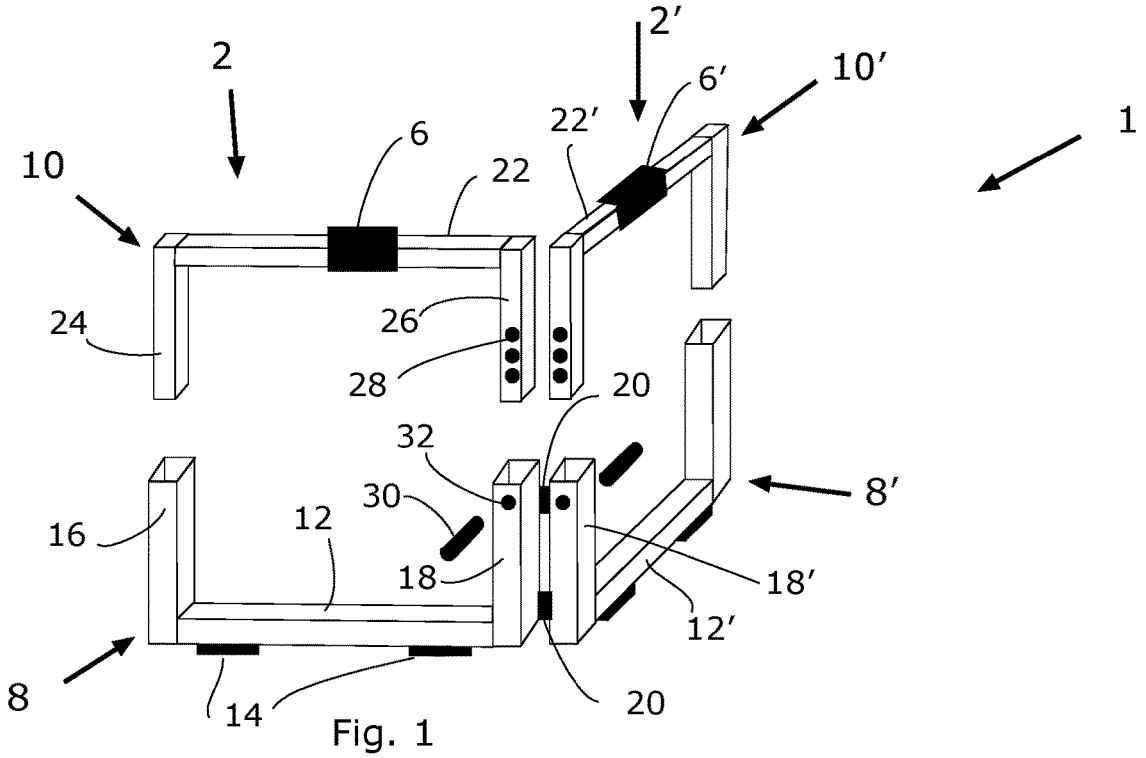
FIG. 1 shows a tridimensional exploded view of exerciser (1).
Figure 2:
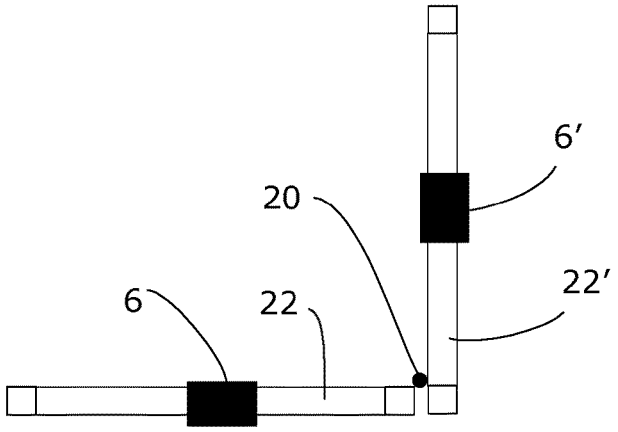
FIG. 2 shows a view from above when exerciser (1) is in open position.
Figure 3:
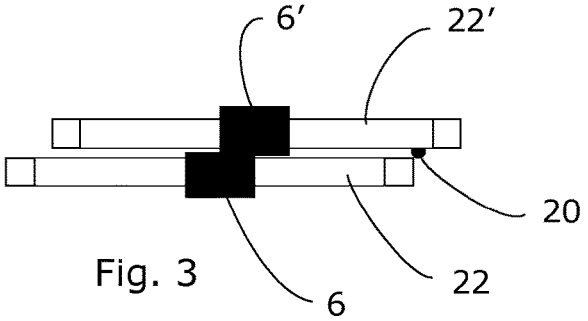
FIG. 3 shows a view from above when exerciser (1) is folded in close position.
Figure 4:
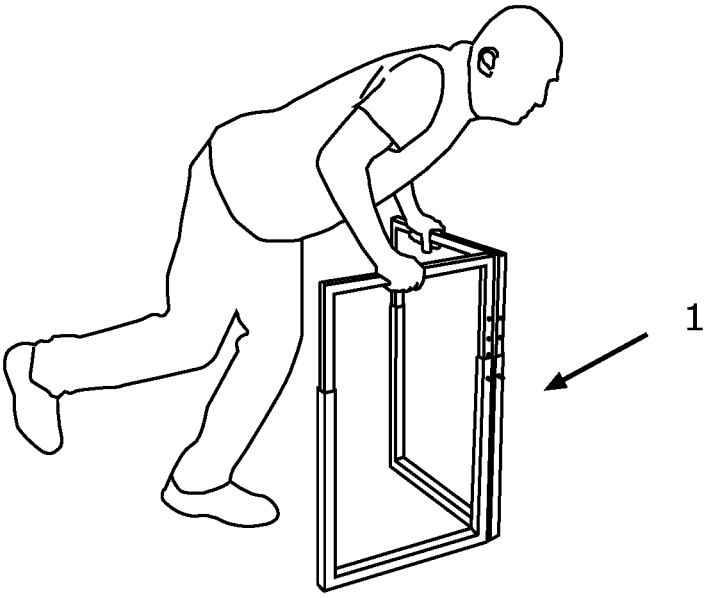
FIG. 4 shows a user of exerciser (1) practicing "Running leaning bended on site exercise".
Figure 5:
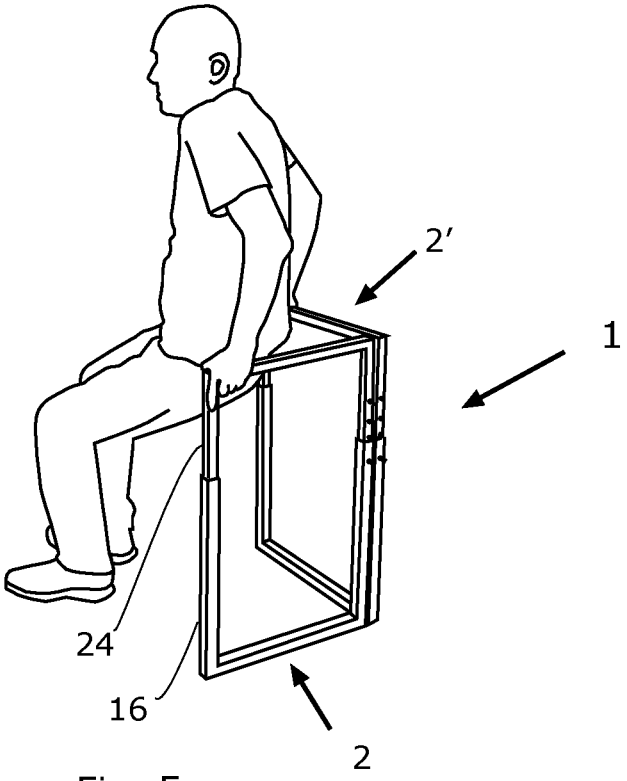
FIG. 5 shows a user of exerciser (1) practicing "Traction in suspension exercise".

Whereby each of said identical rectangle-shaped supports (2,2') is composed by two parts which fit together. With reference to first support (2) it comprises:

a) a U shaped lower part (8)

b) An upside down U shaped upper part (10)

Said U shaped lower part (8) comprises a lower horizontal member (12) and two vertical tubular female elements (16,18), upwards directed. Said lower horizontal member (12) rests on the floor. Said vertical tubular elements (16,18) work as female sliding joints for the housing of vertical lateral male elements (24,26) (disclosed below).

One (18) of vertical tubular elements has hinges (20) for connection with corresponding element (18') of second support (2').

Said upside down U shaped upper part (10) comprises an upper horizontal member (22) usable as a handle-bar and two vertical lateral male elements (24,26), downwards directed.

Said upper horizontal member (22) has a soft handle (6) sliding on said member (22) and is meant to be gripped by user. Each of two vertical tubular male elements (24,26) are slidably housed in each of said tubular female elements (16,18). A sliding blocking device permits the adjusting of height. An embodiment of said device consists in equipping at least one male element (26) with holes (28), meant to house a pin (30) crossing a hole (32) located in corresponding female element (18).

Other embodiment of the invention can be obtained by inverting said male and female elements.

Present description discloses only some way to realize the present invention, which is better defined by the following claims.

The invention claimed is:

1. An exerciser comprising:

a first support element; and a second identical support element;

wherein:

each of the first support element and the second support element is substantially rectangle-shaped;

the first support element includes a lower part, and an upper part;

the lower part is substantially U-shaped, having a lower horizontal member and two vertical tubular female elements upwards directed;

one of the female elements has hinges arranged with their own axis in a vertical direction, the hinges making connection with an adjacent female element of the second support element; and;

the upper part is substantially upside-down U-shaped, having an upper horizontal member, and two vertical male elements downwards directed and slidably housed in the corresponding tubular female elements of the lower part.

2. The exerciser of claim 1, wherein at least one of the vertical elements of the upper part is equipped with holes for housing a pin crossing a hole located in the corresponding female element of the lower part.

3. The exerciser of claim 1, further comprising a soft handle sliding on the upper horizontal member.

4. The exerciser of claim 1, further comprising rubber pads attached on a lower surface of the lower horizontal member.

5. The exerciser of claim 1, wherein the vertical elements of the upper part and the vertical elements of the lower part each has a a rectangular-shaped cross section.

6. The exerciser of claim 5, wherein the hinges are located along an axis of one of the vertical female elements.

7. An exerciser comprising:

a first support element; and a second identical support element;

wherein:

each of the first support element and the second support element is substantially rectangle-shaped;

the first support element includes a lower part, and an upper part;

the upper part is substantially upside-down U-shaped, having an upper horizontal member and two vertical tubular female elements downwards directed;

one of the female elements has hinges arranged with their own axis in a vertical direction, the hinges making connection with an adjacent female element of the second support element; and the lower part is substantially U-shaped, having a lower horizontal member and two vertical male elements upwards directed and slidably housed in the corresponding tubular female elements of the upper part.

8. The exerciser of claim 7, wherein at least one of the vertical elements of the lower part is equipped with holes for housing a pin crossing a hole located in the corresponding female element of the upper part.

9. The exerciser of claim 7, further comprising a soft handle sliding on the upper horizontal member.

10. The exerciser of claim 7, further comprising rubber pads attached on a lower surface of the lower horizontal member.

11. The exerciser of claim 7, wherein the vertical elements of the upper part and the vertical elements of the lower part each has a rectangular-shaped cross section.

12. The exerciser of claim 11, wherein the hinges are located along an axis of one of the vertical female elements.

* * * * *